US008125135B2

(12) United States Patent
Yoo et al.

(10) Patent No.: US 8,125,135 B2
(45) Date of Patent: Feb. 28, 2012

(54) FIELD EMISSION DISPLAY DEVICE

(75) Inventors: Jung Won Yoo, Gyeonggi-do (KR); Mi Sun Kim, Gyeonggi-do (KR); Jae Young Park, Gyeonggi-do (KR); Young Don Park, Gyeonggi-do (KR)

(73) Assignee: Nanopacific Inc., Gyeonggi-do (KR)

( * ) Notice: Subject to any disclaimer, the term of this patent is extended or adjusted under 35 U.S.C. 154(b) by 11 days.

(21) Appl. No.: 12/786,398

(22) Filed: May 24, 2010

(65) Prior Publication Data

US 2011/0285272 A1 Nov. 24, 2011

(51) Int. Cl.
*H01J 1/62* (2006.01)

(52) U.S. Cl. ..... 313/496; 313/495

(58) Field of Classification Search ..... 313/495, 313/309, 336, 351
See application file for complete search history.

(56) References Cited

U.S. PATENT DOCUMENTS 6,803,708 B2 * 10/2004 Simon et al. ..... 313/311
7,042,144 B2 * 5/2006 Takahashi et al. ..... 313/292

FOREIGN PATENT DOCUMENTS

JP 2006-202531 8/2006

* cited by examiner

*Primary Examiner* — Vip Patel
(74) *Attorney, Agent, or Firm* — Portland IP Law LLC; Hosoon Lee

(57) ABSTRACT

A field emission display device (FED) is provided. The FED includes a first substrate, a phosphor layer being in contact with the first substrate, and an anode electrode on the phosphor layer. The FED further includes a second substrate facing the first substrate and including a cathode electrode and an emitter disposed toward the anode electrode.

7 Claims, 22 Drawing Sheets

FIELD EMISSION DISPLAY DEVICE

BACKGROUND

The present disclosure herein relates to field emission display devices and, more particularly, to a field emission display device including a substrate with an anode electrode.

A field emission display (FED) is a type of a flat panel display (FPD) which is thin and operates with a low voltage. An FED is a display device in which images are implemented by light emission of phosphor.

In the FED, electrons emitted from a cathode electrode collide with phosphor to emit light. The emitted light is implemented as an image by passing an anode electrode and a glass substrate. A transparent electrode containing indium tin oxide is well known as the anode electrode. However, because light transmittance of the transparent electrode is lower than 100 percent, luminance of light passing the transparent electrode decreases.

SUMMARY

The present disclosure provides a field emission display capable of improving luminance.

Embodiments of the inventive concept provide a field emission display device (FED) which includes a first substrate, a phosphor layer on the first substrate, and an anode electrode on the phosphor layer.

According to some embodiments of the inventive concept, the FED may further include an auxiliary electrode frame which is disposed on the edge of the anode electrode and extends toward the first substrate.

According to other embodiments of the inventive concept, the FED may further include first auxiliary electrode patterns which are interposed between the first substrate and the phosphor layer and extend in a first direction.

According to other embodiments of the inventive concept, the FED may further include second auxiliary electrode patterns which extends in a second direction crossing the first direction.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION OF THE EMBODIMENTS

Figure 1:
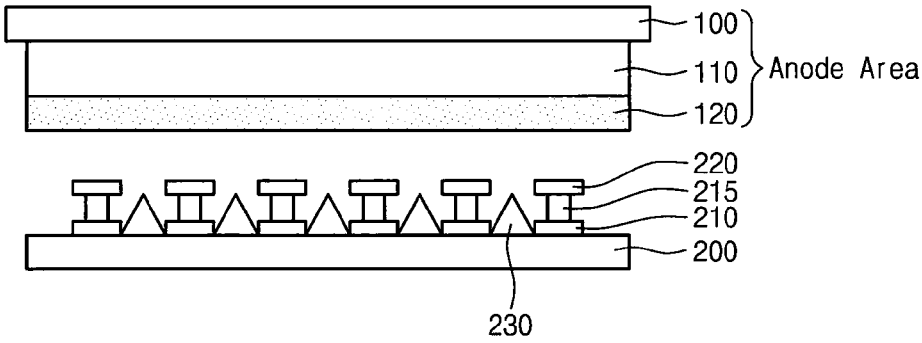
FIGS. 1 to 10B are views illustrating field emission display devices according to embodiments of the inventive concept.

The inventive concept will now be described more fully hereinafter with reference to the accompanying drawings, in which preferred embodiments of the inventive concept are shown. However, the inventive concept may be embodied in many different forms and should not be construed as limited to the embodiments set forth herein. Rather, these embodiments are provided so that this disclosure will be thorough and complete, and will fully convey the scope of the inventive concept to those skilled in the art. In the drawings, the thicknesses of layers and regions are exaggerated for clarity. In this specification, it will also be understood that when a element is referred to as being "on" another element or substrate, it can be directly on the another element or substrate, or intervening elements may also be present. Like numbers refer to like elements throughout.

As used herein, the term "and/or" includes any and all combinations of one or more of the associated listed items. It will be understood that when an element is referred to as being "connected" or "coupled" to another element, it may be directly connected or coupled to the other element or intervening elements may be present. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Referring to FIG. 1, a field emission display device (FED) according to an embodiment of the inventive concept will now be described in detail. A phosphor layer 110 is provided on a first substrate 100. The first substrate 100 may be a transparent substrate including a glass substrate. The phosphor layer 110 may include phosphor. An anode electrode 120 is disposed on the phosphor layer 110. The anode electrode 120 may include a conductive material having sheet resistance of 1000 ohms/square or less. Preferably, the anode electrode 120 may include a conductive material having sheet resistance of 100 ohms/square or less. The anode electrode 120 may include aluminum (Al), copper (Cu), silver (Ag), gold (Au), platinum (Pt), tungsten (W) or combinations thereof. When the sheet resistance of the anode electrode 120 is 1000 ohms/square or greater, arcing may arise from charging. The anode electrode 120 may provide electrodes to the phosphor layer 110.

A second substrate 200 is provided to face the first substrate 100. Cathode electrodes 210 are provided on the second substrate 200. Gate electrodes 220 may be provided on the cathode electrodes 210. Insulating layers 215 may be further interposed between the cathode electrodes 210 and the gate electrodes 220. Emitters 230 may be provided in regions adjacent to laminate structures of the cathode electrodes 210 and the gate electrode 220 on the second substrate 200. For example, the emitters 230 may be disposed between the laminate structures of the cathode electrodes 210 and the gate electrodes 220.

When a voltage is applied to the cathode electrodes 210 and the gate electrodes 220, electrons are emitted from the emitters 230 due to a difference in voltage between both the electrodes 210 and 220. The emitted electrons may collide with phosphor of the phosphor layer 110 after passing the anode electrode 120. The phosphor transitions to an excited state due to the collision with the electrons and emits lights while retuning to a ground state. The light may implement an image by passing the first substrate 100. The anode electrode 120 may induce the electrons in a direction of the phosphor layer 110. The anode electrode 120 may reflect the electrons colliding with the phosphor in the direction of the phosphor layer 110. The anode electrode 120 may prevent accumulation of the electrons at the phosphor layer 110 to maintain characteristics of the phosphor layer 110.

Figure 2A:
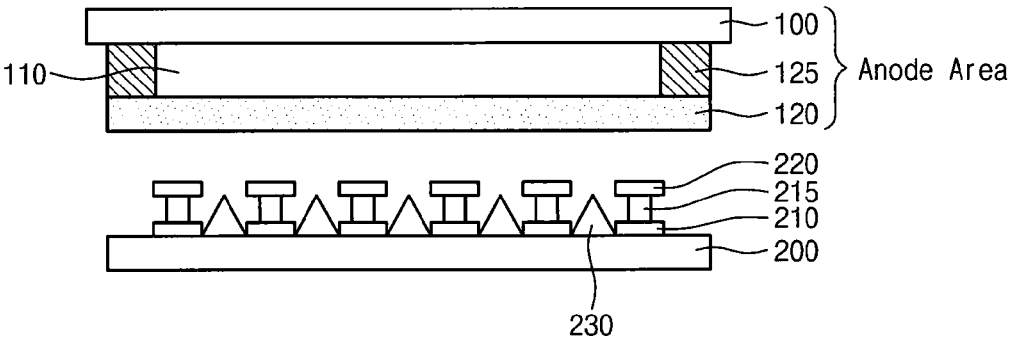
Figure 2B:
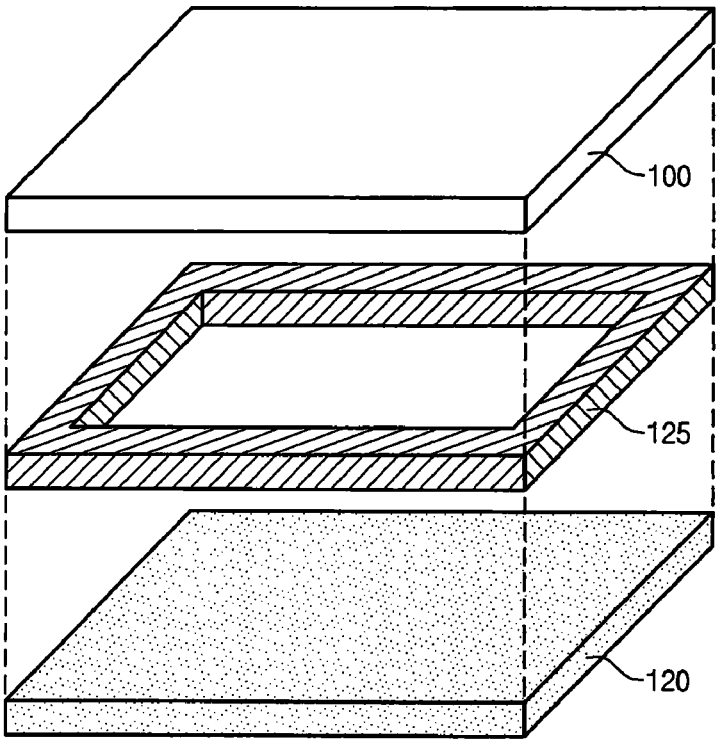

Referring to FIGS. 2A and 2B, a field emission display device (FED) according to another embodiment of the inventive concept will now be described in detail. FIG. 2B is a three-dimensional diagram of an anode area shown in FIG. 2A. A phosphor layer 110 is provided on a first substrate 100. An anode electrode 120 is provided on the phosphor layer 110. The anode electrode 120 may include a conductive material having sheet resistance of 1000 ohms/square or less. Preferably, the anode electrode may include a conductive material of 100 ohms/square or less. The anode electrode 120 may include, for example, aluminum (Al), copper (Cu), silver (Ag), gold (Au), platinum (Pt), tungsten (W) or combinations thereof.

An auxiliary electrode frame 125 may be interposed between the edge of the anode electrode 120 and the first substrate 100. The auxiliary electrode frame 125 may include at least one selected from the group consisting of silver (Ag), copper (Cu), nickel (Ni), aluminum (Al), zinc (Zn), titanium (Ti), platinum (Pt), tungsten (W), indium tin oxide, indium zinc oxide, and tin oxide. The auxiliary electrode frame 125 may be electrically connected to the anode electrode 120. The auxiliary electrode frame 125 may provide an electrical path to discharge electrons which reaches the phosphor layer 110 after transmitting the anode electrode 120. The auxiliary electrode frame 125 may prevent accumulation of electrons in the phosphor layer 110 so as to suppress deterioration in characteristics of the phosphor layer 110. The auxiliary electrode frame 125 may promote adherence between the anode electrode 120 and the phosphor layer 110.

A second substrate 200 is provided to face the first substrate 100. Cathode electrodes 210 are provided on the second substrate 200. Gate electrodes 220 may be provided on the cathode electrodes 210. Insulating layers 215 may be further interposed between the cathode electrodes 210 and the gate electrodes 220. Emitters 230 may be provided in regions adjacent to laminate structures of the cathode electrodes 210 and the gate electrode 220. For example, the emitters 230 may be disposed between the laminate structures of the cathode electrodes 210 and the gate electrodes 220.

Figure 3A:
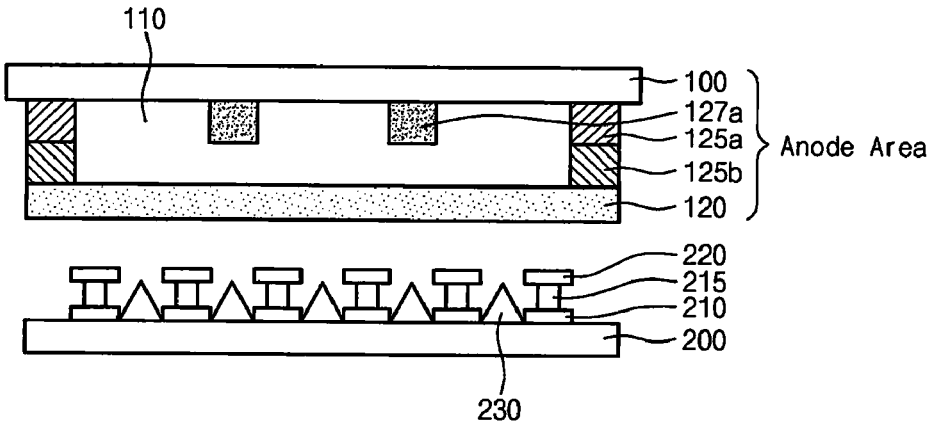
Figure 3B:
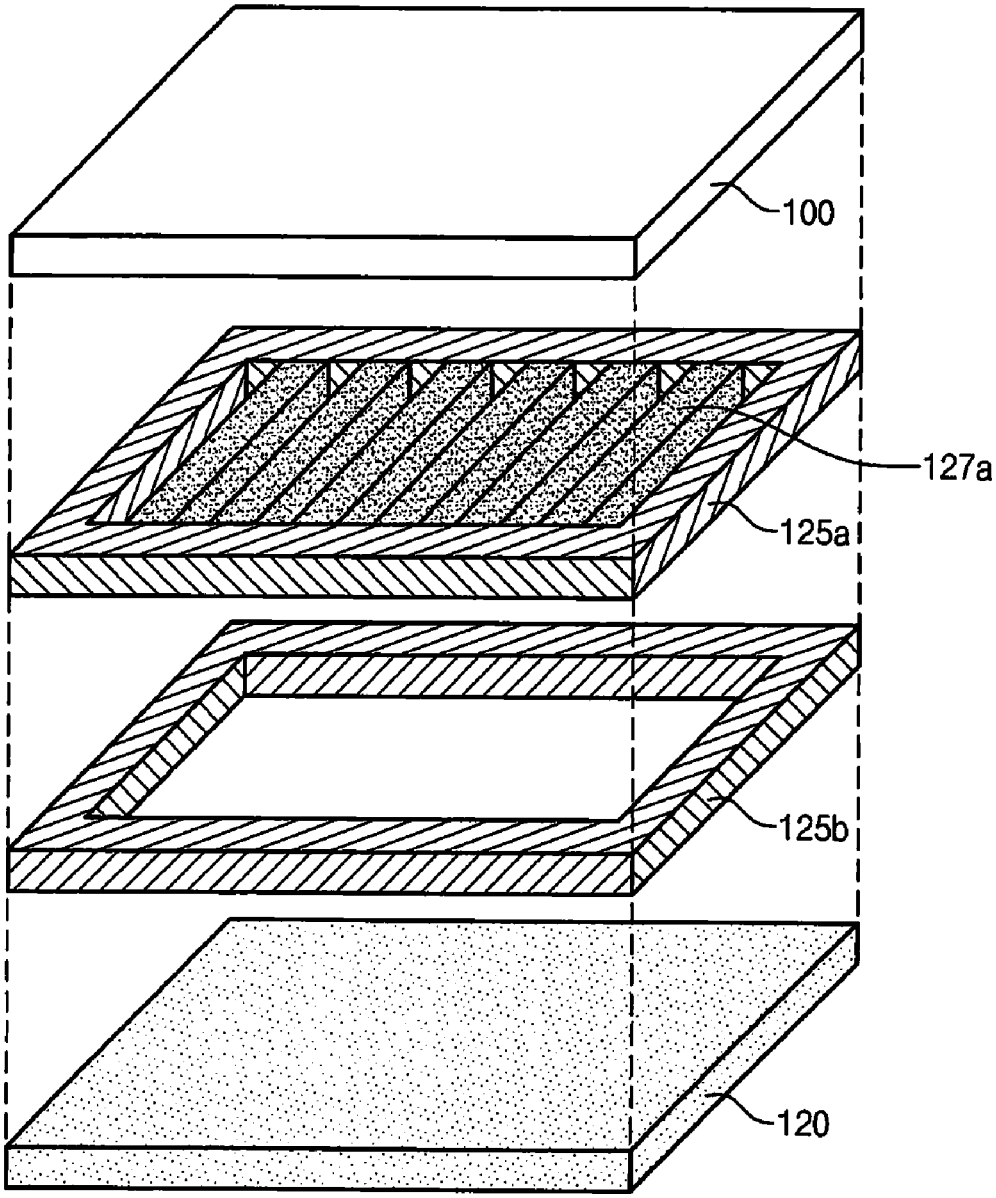

Referring to FIGS. 3A and 3B, a field emission display device (FED) according to another embodiment of the inventive concept will now be described in detail. FIG. 3B is a three-dimensional diagram of an anode area shown in FIG. 3A. A phosphor layer 110 is provided on a first substrate 100. An anode electrode 120 is provided on the phosphor layer 110. Auxiliary electrode frames 125*a* and 125*b* may be interposed between the edge of the anode electrode 120 and the first substrate 100. The phosphor layer 110 may be surrounded by the first substrate 100, the anode electrode 120, and the auxiliary electrode frames 125*a* and 125*b*. The auxiliary electrode frames 125*a* and 125*b* may include a first auxiliary electrode frame 125*a* that is adjacent to the first substrate 100 and a second auxiliary electrode frame 125*b* that is in contact with the first auxiliary electrode frame 125*a* and is adjacent to the anode electrode 120.

The first auxiliary electrode frame 125*a* may include at least one selected from the group consisting of silver (Ag), copper (Cu), nickel (Ni), aluminum (Al), zinc (Zn), titanium (Ti), platinum (Pt), tungsten (W), indium tin oxide, indium zinc oxide, and tin oxide. The second auxiliary electrode frame 125*b* may include at least one selected from the group consisting of silver (Ag), copper (Cu), nickel (Ni), aluminum (Al), zinc (Zn), titanium (Ti), platinum (Pt), tungsten (W), indium tin oxide, indium zinc oxide, and tin oxide.

First auxiliary electrode patterns 127*a* may be provided between the first substrate 100 and the phosphor layer 110. The first auxiliary electrode patterns 127*a* may be surrounded by the phosphor layer 110. The first auxiliary electrode patterns 127*a* may have the same height as the first auxiliary electrode frame 125*a*. The first auxiliary electrode pattern 127*a* may include a conductive material. The first auxiliary electrode patterns 127*a* may include at least one selected from the group consisting of silver (Ag), copper (Cu), nickel (Ni), aluminum (Al), zinc (Zn), titanium (Ti), platinum (Pt), tungsten (W), indium tin oxide, indium zinc oxide, and tin oxide. The first auxiliary electrode patterns 127*a* may be disposed on a region defined by the first auxiliary electrode frame 125*a* and may divide the region into a plurality of regions. For example, a stripe patterned frame may be defined by the first auxiliary electrode frame 125*a* and the first auxiliary electrode patterns 127*a*.

A second substrate 200 is provided to face the first substrate 100. Cathode electrodes 210 are provided on the second substrate 200. Gate electrodes 220 may be provided on the cathode electrodes 210. Insulating layers 215 may be further interposed between the cathode electrodes 210 and the gate electrodes 220. Emitters 230 may be provided on regions adjacent to laminate structures of the cathode electrodes 210 and the gate electrode 220. For example, the emitters 230 may be disposed between the laminate structures of the cathode electrodes 210 and the gate electrodes 220.

Figure 4A:
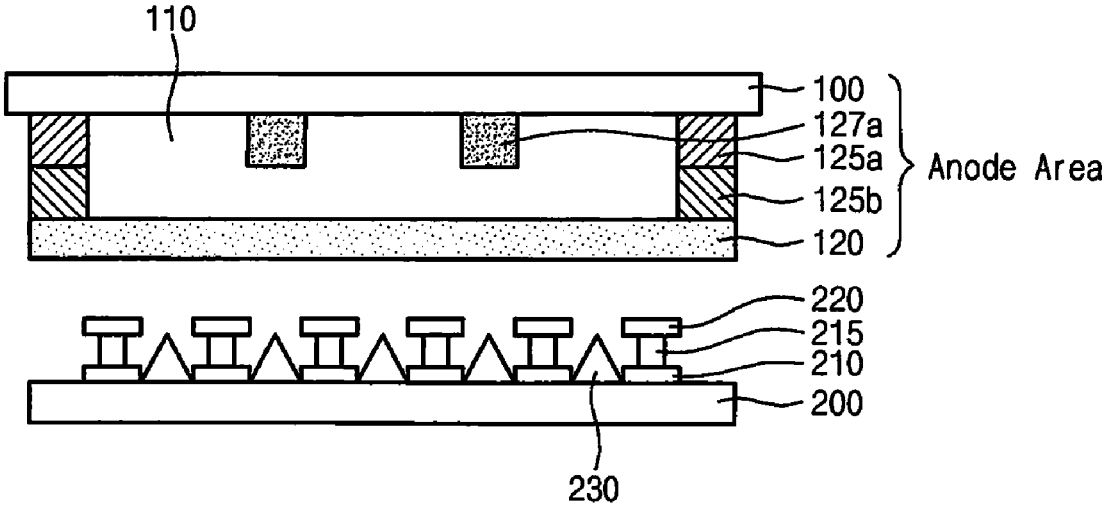
Figure 4B:
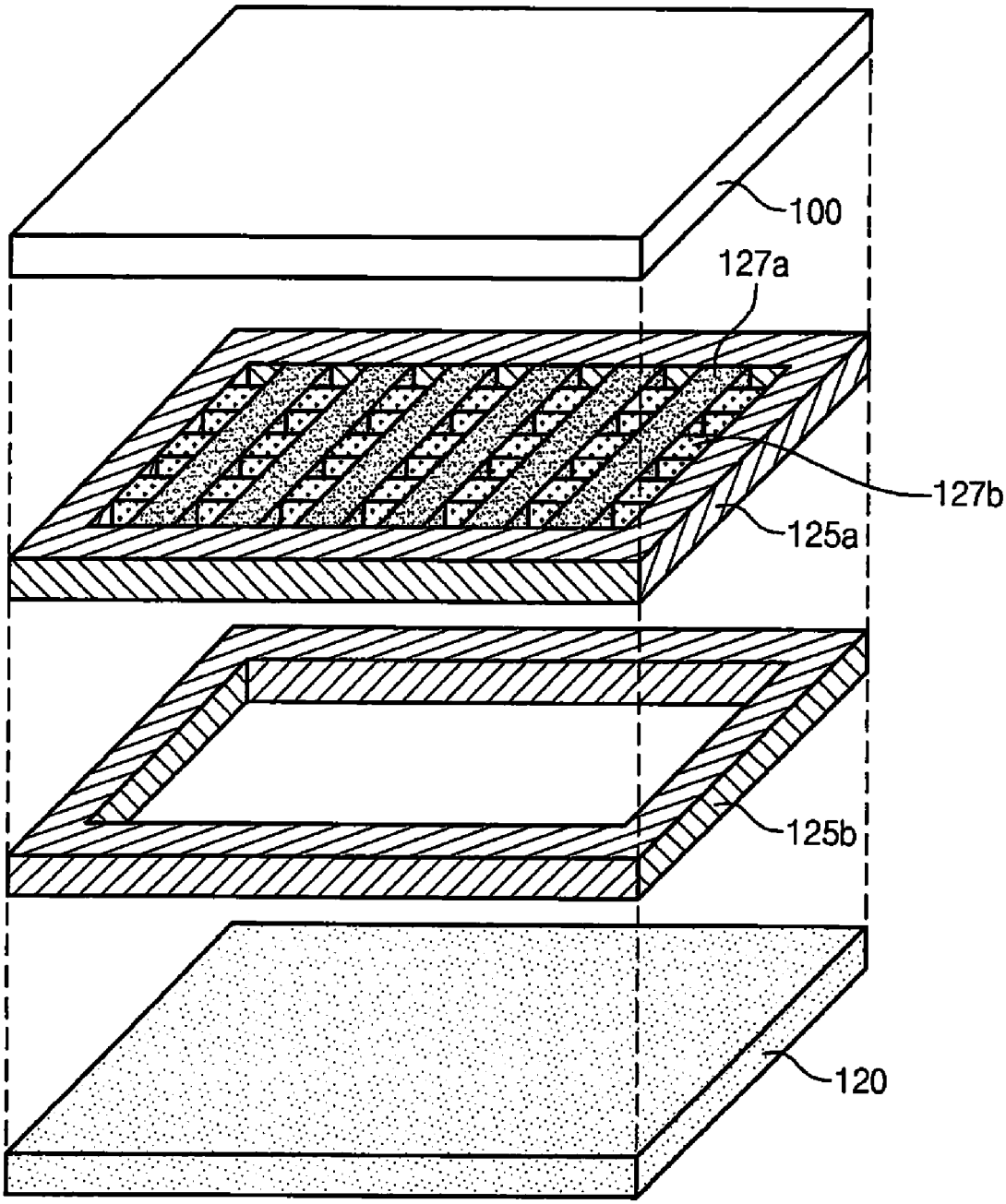

Referring to FIGS. 4A and 4B, a field emission display device (FED) according to another embodiment of the inventive concept will now be described in detail. FIG. 4B is a three-dimensional diagram of an anode area shown in FIG. 4A. Referring to FIG. 4B, second auxiliary electrode patterns 127*b* may be further provided between the first substrate 100 and the phosphor layer 110 shown in FIG. 3*b*. The second auxiliary electrode patterns 127*b* may be electrically connected to the first auxiliary electrode frame 125*a* and the first auxiliary electrode patterns 127*a*. The second auxiliary electrode patterns 127*b* may be disposed on a region defined by the first auxiliary electrode frame 125*a* and the first auxiliary electrode patterns 127*a* and may divide the region into a plurality of regions. For example, a lattice patterned frame may be defined by the first auxiliary electrode frame 125*a*, the first auxiliary electrode patterns 127*a*, and the second auxiliary electrode patterns 127*b*.

The second auxiliary electrode patterns 127*b* may be a conductive material. The second auxiliary electrode patterns 127*b* may include at least one selected from the group consisting of silver (Ag), copper (Cu), nickel (Ni), aluminum (Al), zinc (Zn), titanium (Ti), platinum (Pt), tungsten (W), indium tin oxide, indium zinc oxide, and tin oxide. Driving stability of the FED may be ensured by the first auxiliary electrode patterns 127*a* and the second auxiliary electrode patterns 127*b*.

A second substrate 200 is provided to face the first substrate 100. Cathode electrodes 210 are provided on the second substrate 200. Gate electrodes 220 may be provided on the cathode electrodes 210. Insulating layers 215 may be further interposed between the cathode electrodes 210 and the gate electrodes 220. Emitters 230 may be provided on regions adjacent to laminate structures of the cathode electrodes 210 and the gate electrode 220. For example, the emitters 230 may be disposed between the laminate structures of the cathode electrodes 210 and the gate electrodes 220.

Figure 5A:
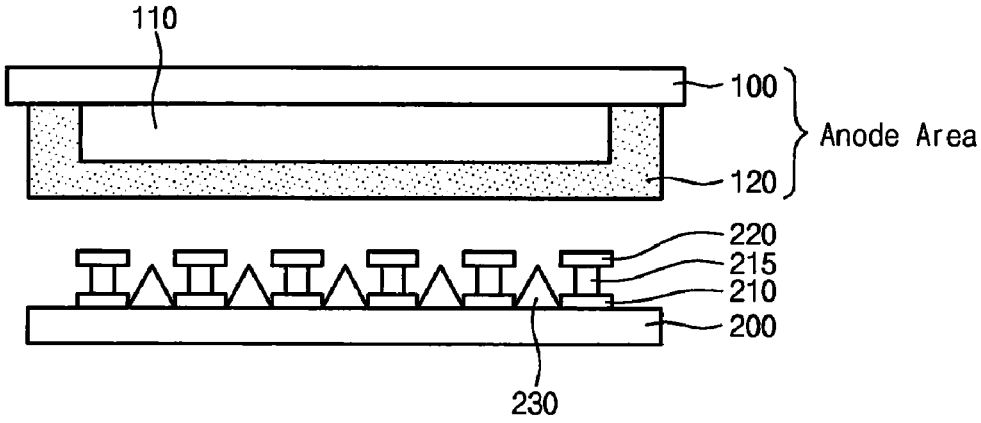
Figure 5B:
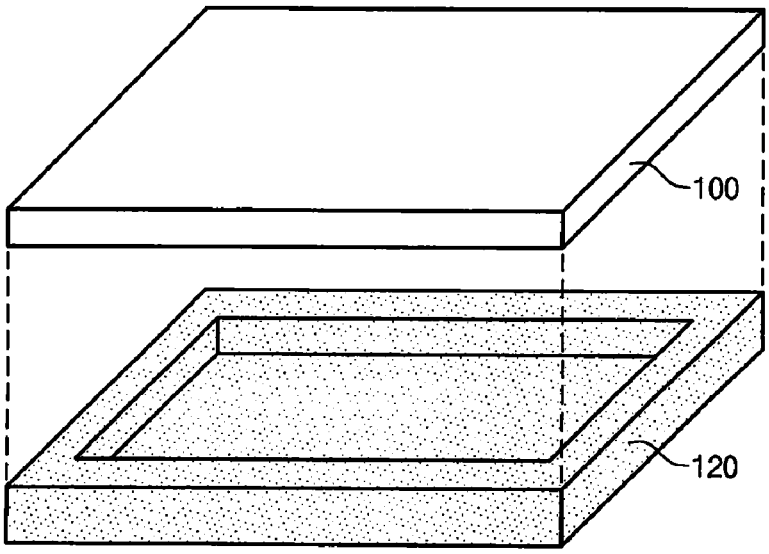

Referring to FIGS. 5A and 5B, a field emission display device (FED) according to another embodiment of the inventive concept will now be described in detail. FIG. 5B is a three-dimensional diagram of an anode area shown in FIG. 5A. On a first substrate 100, an anode electrode 120 may be provided with a projection protruded in a direction of the first substrate 100. The projection may be in contact with the edge of the first substrate 100. A phosphor layer 110 may be provided in a region defined by the anode electrode 120 and the first substrate 100. The phosphor layer 110 may be surrounded by the anode electrode 120 and the first substrate 100.

A second substrate 200 is provided to face the first substrate 100. Cathode electrodes 210 are provided on the second substrate 200. Gate electrodes 220 may be provided on the cathode electrodes 210. Insulating layers 215 may be further interposed between the cathode electrodes 210 and the gate electrodes 220. Emitters 230 may be provided on regions adjacent to laminate structures of the cathode electrodes 210 and the gate electrode 220. For example, the emitters 230 may be disposed between the laminate structures of the cathode electrodes 210 and the gate electrodes 220.

Figure 6A:
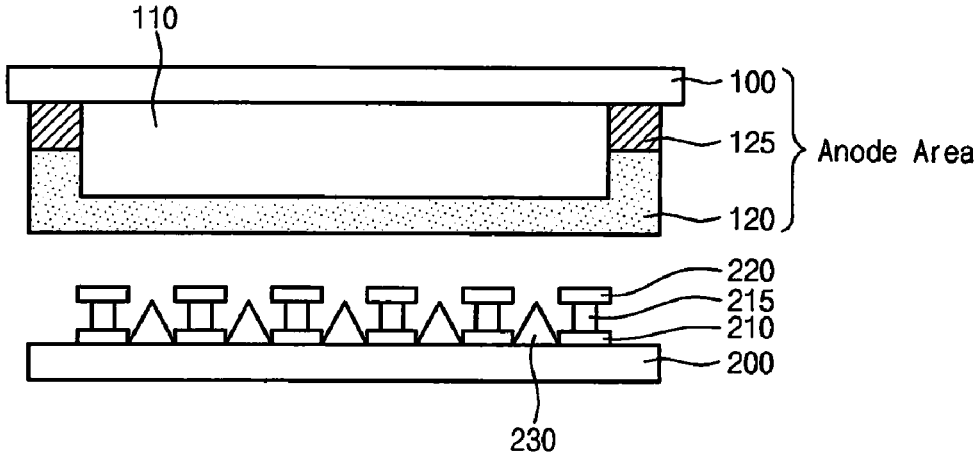
Figure 6B:
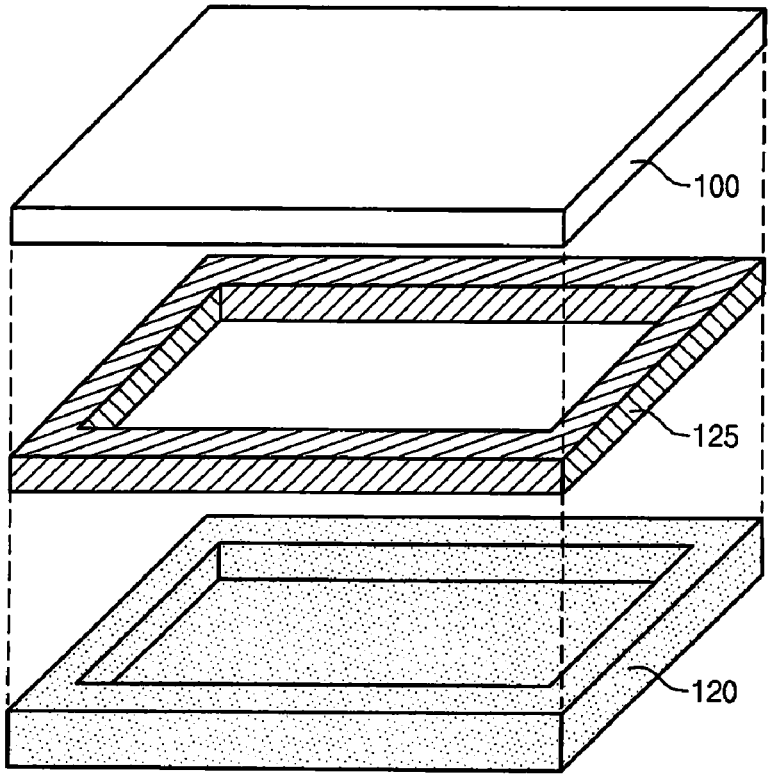

Referring to FIGS. 6A and 6B, a field emission display device (FED) according to another embodiment of the inventive concept will now be described in detail. FIG. 6B is a three-dimensional diagram of an anode area shown in FIG. 6A. On a first substrate 100, an anode electrode 120 may be provided with a projection extending in a direction of the first substrate 100. The projection may be disposed at the edge of the anode electrode 120.

An auxiliary electrode frame 125 may be interposed between the projection of the anode electrode 120 and the first substrate 100. The auxiliary electrode frame 125 may include at least one selected from the group consisting of silver (Ag), copper (Cu), nickel (Ni), aluminum (Al), zinc (Zn), titanium (Ti), platinum (Pt), tungsten (W), indium tin oxide, indium zinc oxide, and tin oxide.

A phosphor layer 110 may be provided in a region defined by the anode electrode 120, the first substrate 100, and the auxiliary electrode frame 125. The phosphor layer 110 may be surrounded by the anode electrode 120, the first substrate 100, and the auxiliary electrode frame 125.

A second substrate 200 may be provided to face the first substrate 100. Cathode electrodes 210 are provided on the second substrate 200. Gate electrodes 220 may be provided on the cathode electrodes 210. Insulating layers 215 may be further interposed between the cathode electrodes 210 and the gate electrodes 220. Emitters 230 may be provided at regions adjacent to laminate structures of the cathode electrodes 210 and the gate electrode 220. For example, the emitters 230 may be disposed between the laminate structures of the cathode electrodes 210 and the gate electrodes 220.

Figure 7A:
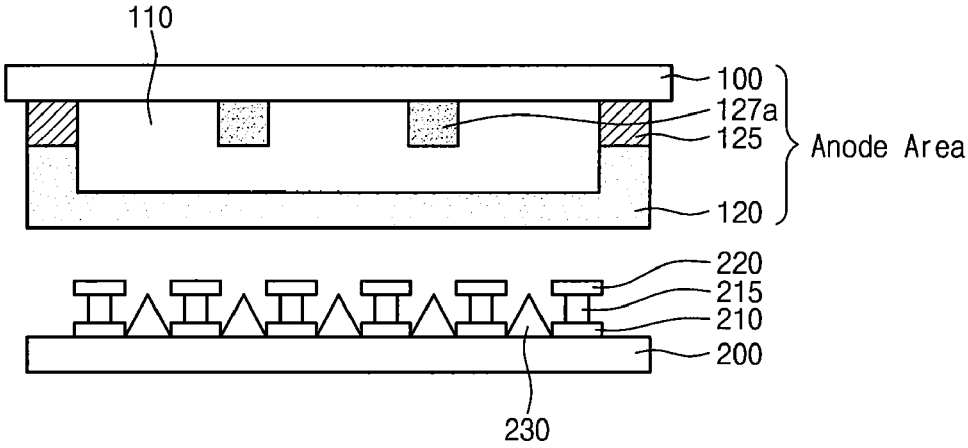
Figure 7B:
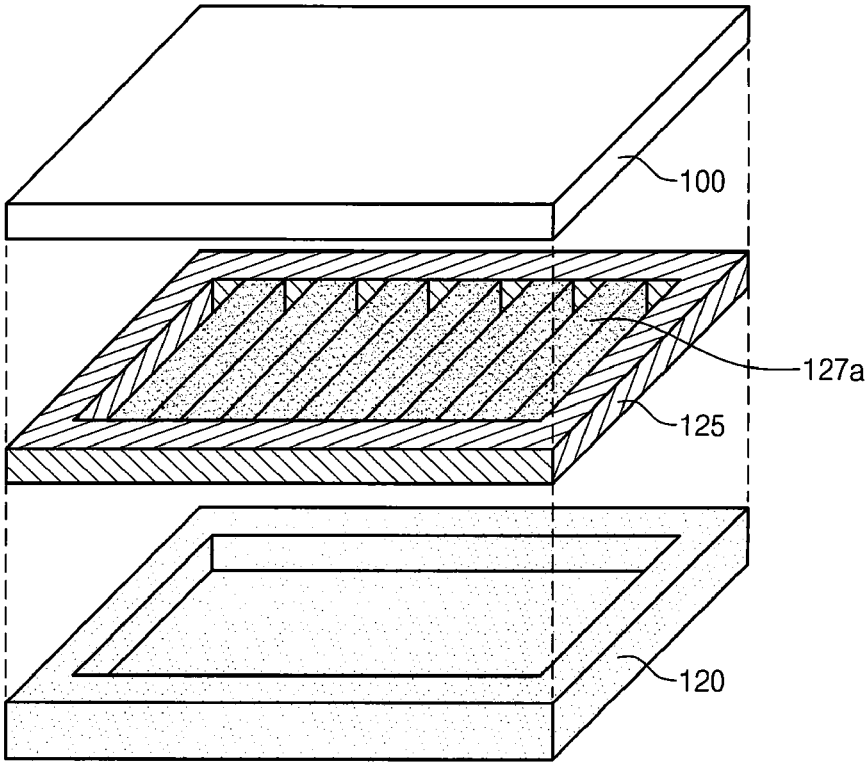

Referring to FIGS. 7A and 7B, a field emission display device (FED) according to another embodiment of the inventive concept will now be described in detail. FIG. 7B is a three-dimensional diagram of an anode area shown in FIG. 7A. On a first substrate 100, an anode electrode 120 is provided with a projection protruded in a direction of the first substrate 100. The projection may be disposed on the edge of the anode electrode 120. An auxiliary electrode frame 125 may be provided between the projection of the anode electrode 120 and the edge of the first substrate 100. A phosphor layer 110 may be provided in a region defined by the first substrate 100, the anode electrode 120, and the auxiliary electrode frame 125. The phosphor layer 110 may be surrounded by the first substrate 100, the anode electrode 120, and the auxiliary electrode frame 125.

First auxiliary electrode patterns 127*a* may be provided in a region defined by the auxiliary electrode frame 125. The first auxiliary electrode patterns 127*a* may be interposed between the first substrate 100 and the phosphor layer 110. The height of the auxiliary electrode frame 125 may be substantially equal to that of the first auxiliary electrode patterns 127*a*. The auxiliary electrode frame 125 and the first auxiliary electrode patterns 127*a* may be electrically connected to each other.

Figure 8A:
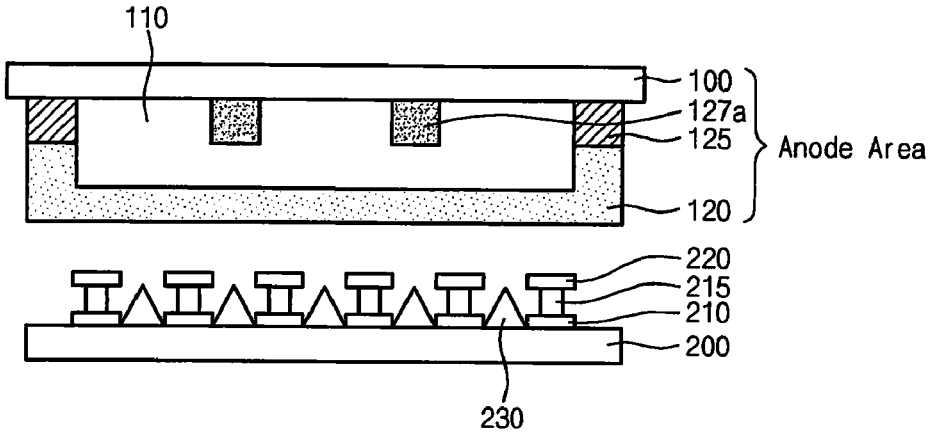
Figure 8B:
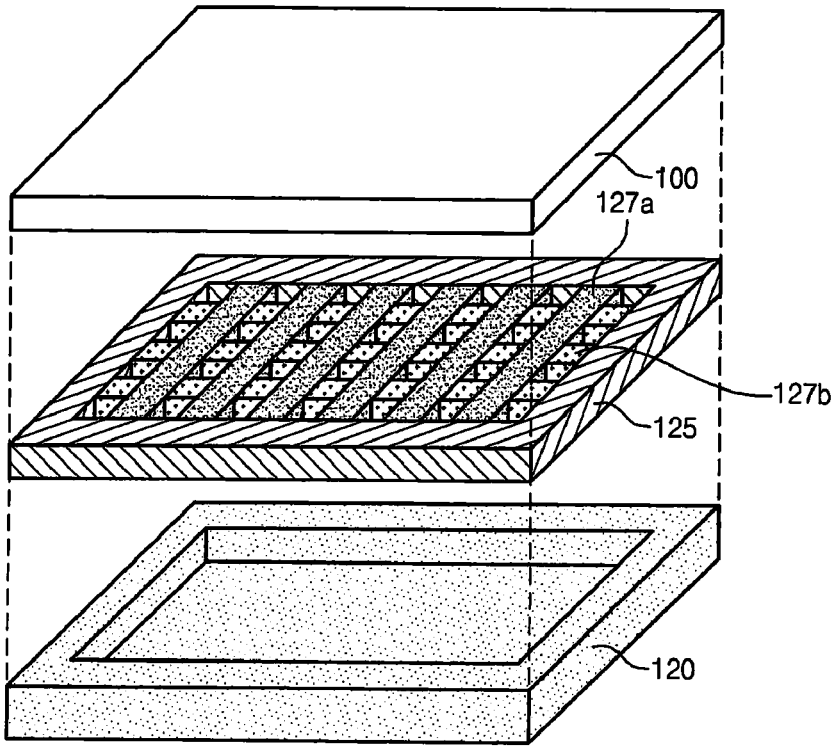

Referring to FIGS. 8A and 8B, a field emission display device (FED) according to another embodiment of the inventive concept will now be described in detail. FIG. 8B is a three-dimensional diagram of an anode area shown in FIG. 8A. Second auxiliary electrode patterns 127*b* may be further provided on the structure shown in FIG. 7B in a direction crossing an extending direction of the first auxiliary electrode patterns 127*a*. The second auxiliary electrode patterns 127*b* may be disposed in a region defined by the auxiliary electrode frame 125 and the first auxiliary electrode patterns 127*a* and may divide the region into a plurality of regions. The second auxiliary electrode patterns 127*b* may have the same height as the auxiliary electrode frame 125 and the first auxiliary electrode patterns 127*a*. The second auxiliary electrode patterns 127*b* may be spaced apart from the anode electrode 120. A phosphor layer 110 may be interposed between the second auxiliary electrode patterns 127*b* and the anode electrode 120.

A second substrate 200 is provided to face the first substrate 100. Cathode electrodes 210 are provided on the second substrate 200. Gate electrodes 220 may be provided on the cathode electrodes 210. Insulating layers 215 may be further interposed between the cathode electrodes 210 and the gate electrodes 220. Emitters 230 may be provided on regions adjacent to laminate structures of the cathode electrodes 210 and the gate electrode 220. For example, the emitters 230 may be disposed between the laminate structures of the cathode electrodes 210 and the gate electrodes 220.

Figure 9A:
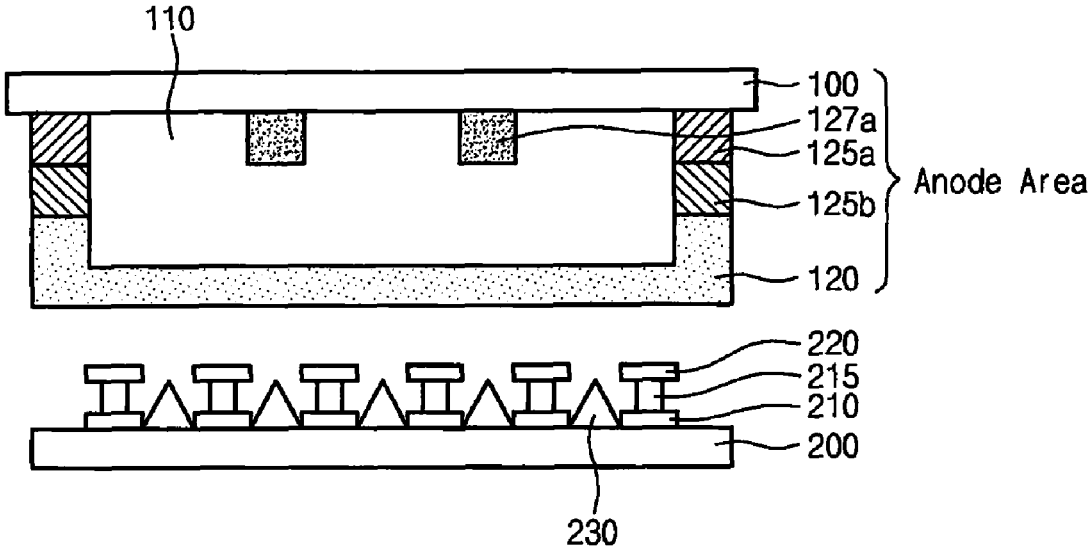
Figure 9B:
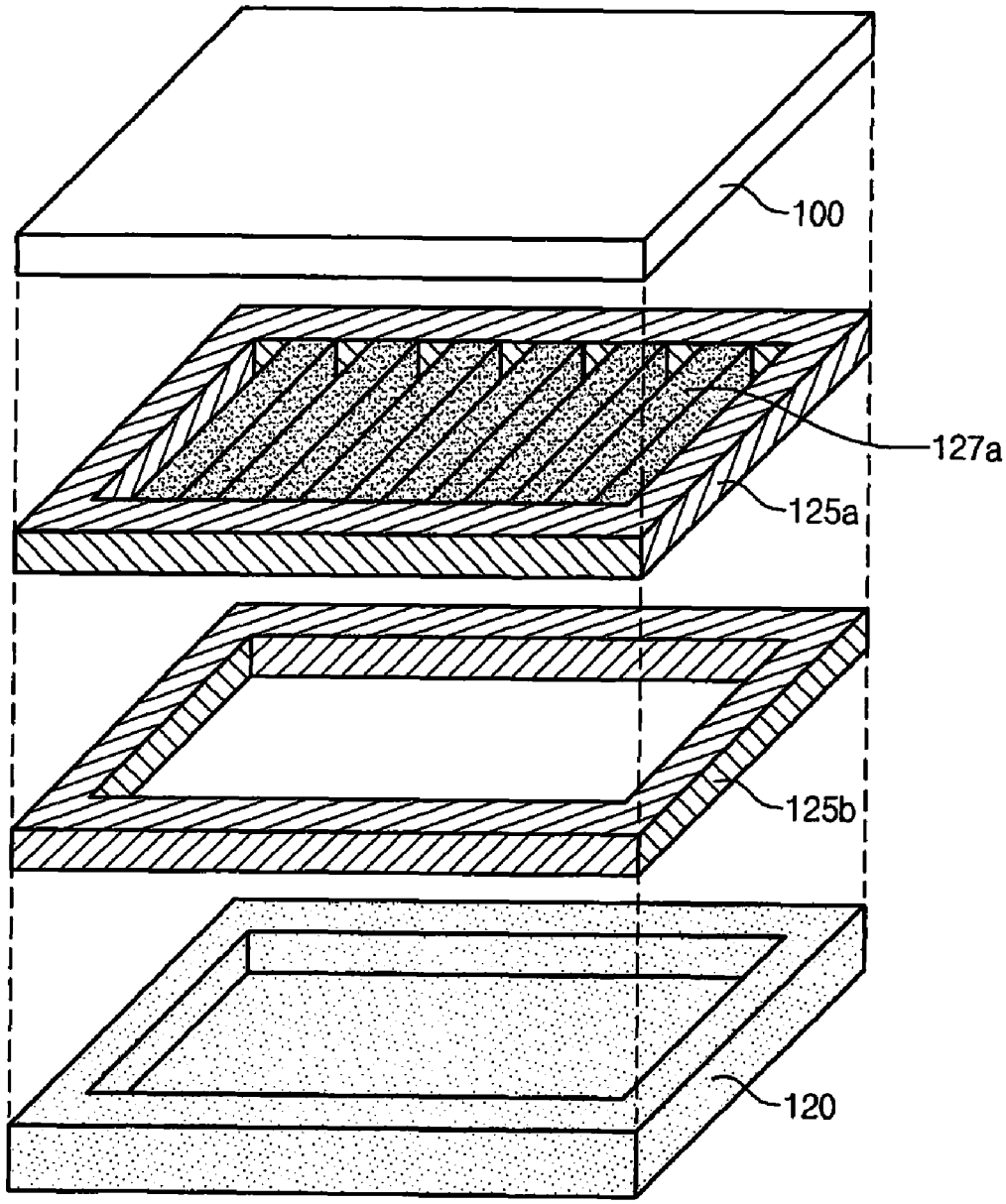

Referring to FIGS. 9A and 9B, a field emission display device (FED) according to another embodiment of the inventive concept will now be described in detail. FIG. 9B is a three-dimensional diagram of an anode area shown in FIG. 9A. A phosphor layer 110 is provided on a first substrate 100. On the phosphor layer 110, an anode electrode 120 is provided with a projection facing toward the first substrate 100. The projection may be disposed on the edge of the anode electrode 120. Auxiliary electrode frames 125*a* and 125*b* may be provided between the projection and the edge of the first substrate 100. The phosphor layer 110 may be disposed in a region defined by the fist substrate 100, the auxiliary electrode frames 125*a* and 125*b*, and the anode electrode 120. The auxiliary electrode frames 125*a* and 125*b* may include at least two layers. The auxiliary electrode frames 125*a* and 125*b* may include first auxiliary electrode frame 125*a* adjacent to the first substrate 100 and second auxiliary electrode frame 125*b* adjacent to the anode electrode 120.

First auxiliary electrode patterns 127*a* may be provided between the first substrate 100 and the phosphor layer 110. The first auxiliary electrode patterns 127*a* may be disposed in a region defined by the first auxiliary electrode frame 125*a* and may be electrically connected to the first auxiliary electrode frame 125*a*.

A second substrate 200 is provided to face the first substrate 100. Cathode electrodes 210 are provided on the second substrate 200. Gate electrodes 220 may be provided on the cathode electrodes 210. Insulating layers 215 may be further interposed between the cathode electrodes 210 and the gate electrodes 220. Emitters 230 may be provided on regions adjacent to laminate structures of the cathode electrodes 210 and the gate electrode 220. For example, the emitters 230 may be disposed between the laminate structures of the cathode electrodes 210 and the gate electrodes 220.

Figure 10A:
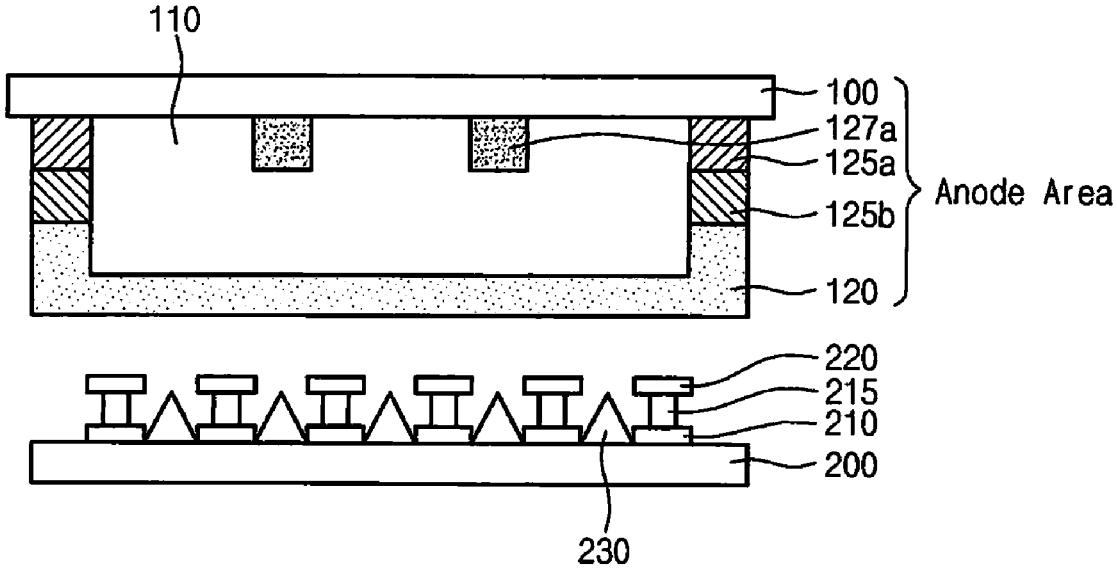
Figure 10B:
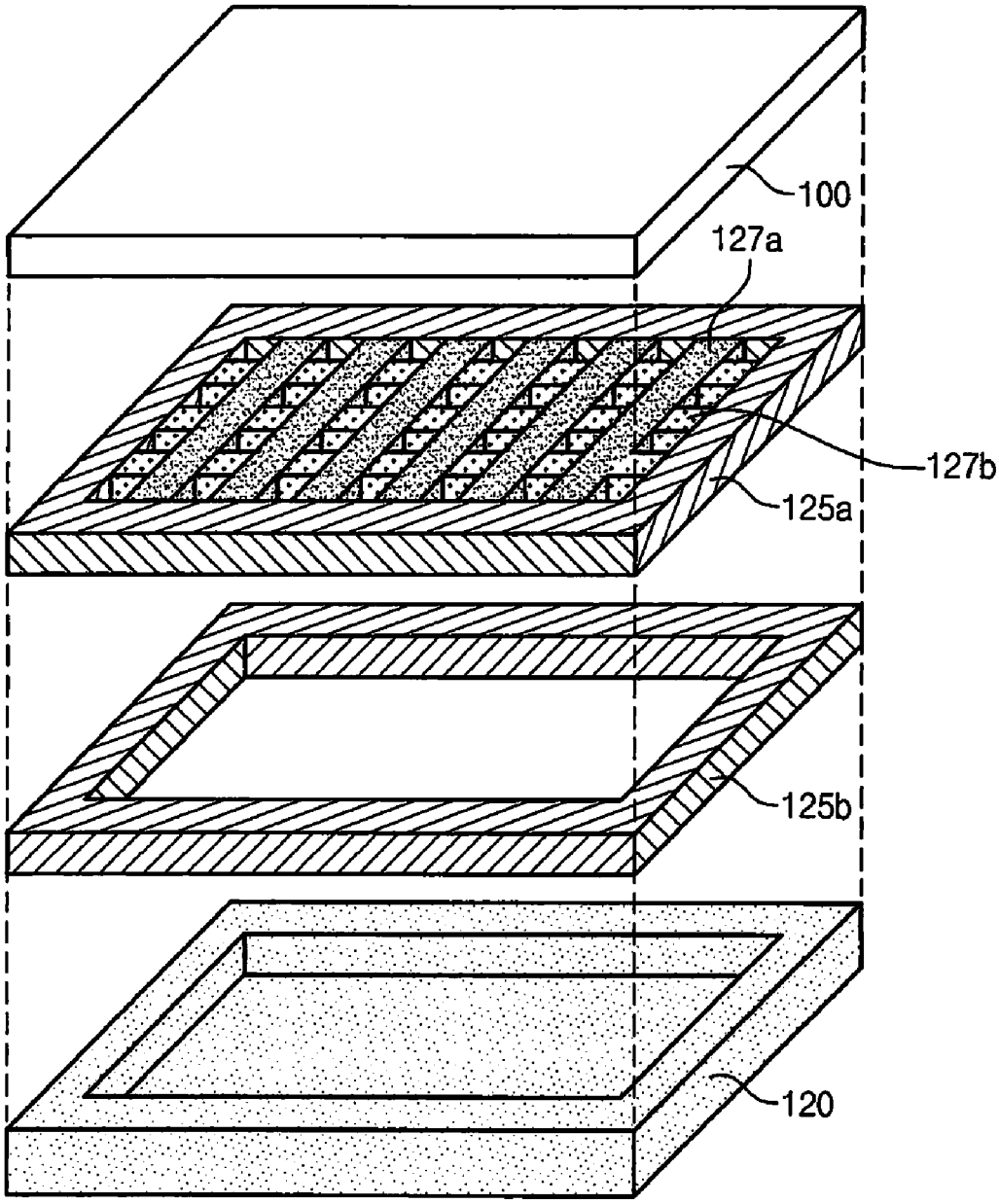

Referring to FIGS. 10A and 10B, a field emission display device (FED) according to another embodiment of the inventive concept will now be described in detail. FIG. 10B is a three-dimensional diagram of an anode area shown in FIG. 10A. Second auxiliary electrode patterns 127*b* may be provided in a direction crossing the first auxiliary electrode patterns 127*a* shown in FIG. 9B. The second auxiliary electrode patterns 127*b* may be electrically connected to the first auxiliary electrode frame 125*a* and the first auxiliary electrode patterns 127*a*.

A second substrate 200 is provided to face the first substrate 100. Cathode electrodes 210 are provided on the second substrate 200. Gate electrodes 220 may be provided on the cathode electrodes 210. Insulating layers 215 may be further interposed between the cathode electrodes 210 and the gate electrodes 220. Emitters 230 may be provided on regions adjacent to laminate structures of the cathode electrodes 210 and the gate electrode 220. For example, the emitters 230 may be disposed between the laminate structures of the cathode electrodes 210 and the gate electrodes 220.

Figure 11:
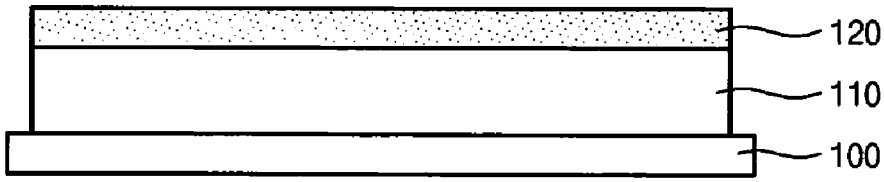
FIGS. 11 to 17B are views illustrating methods for fabricating a field emission display device according to embodiments of the inventive concept.

Referring to FIG. 11, a method for fabricating a field emission display device (FED) according to an embodiment of the inventive concept will now be described in detail. A phosphor layer 110 is formed on a first substrate 100. The phosphor layer 110 may be formed by conventional film forming methods including a printing method, a slurry method, a lithography method, and an electrophoresis method. An anode electrode 120 is formed on the phosphor layer 110. The anode electrode 120 may include a conductive material having sheet resistance of 1000 ohms/square or less. Preferably, the anode electrode 120 may include a conductive material having sheet resistance of 100 ohms/square or less. For example, the anode electrode 120 may include aluminum (Al), copper (Cu), silver (Ag), gold (Au), platinum (Pt), tungsten (W) or combinations thereof. The anode electrode 120 may be formed by transferring a film coated with a conductive material onto the phosphor layer 110 and baking the transferred film. Meanwhile, the anode electrode 120 may be formed by conventional conductive thin-film forming methods including a sputtering method, a vacuum evaporation method, and a printing method. As a result, an anode area shown in FIG. 1 may be formed.

Figure 12A:
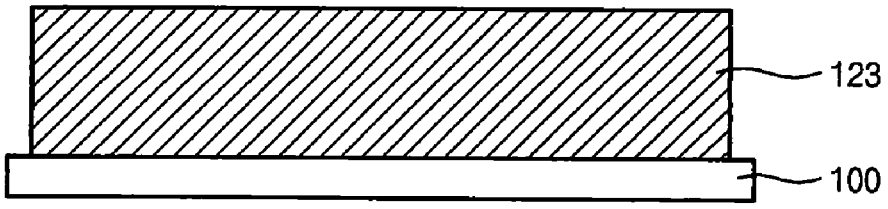
Figure 12B:
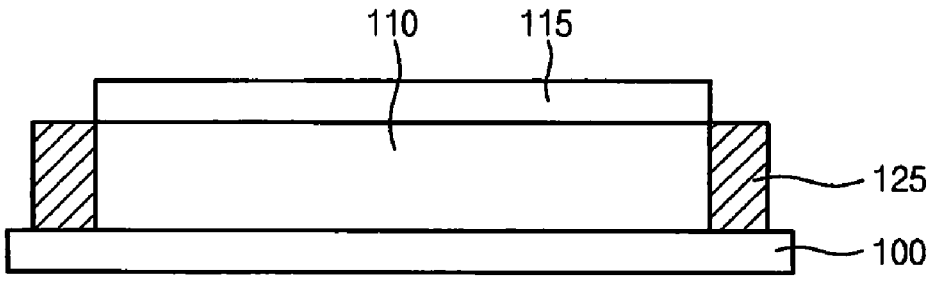
Figure 12C:
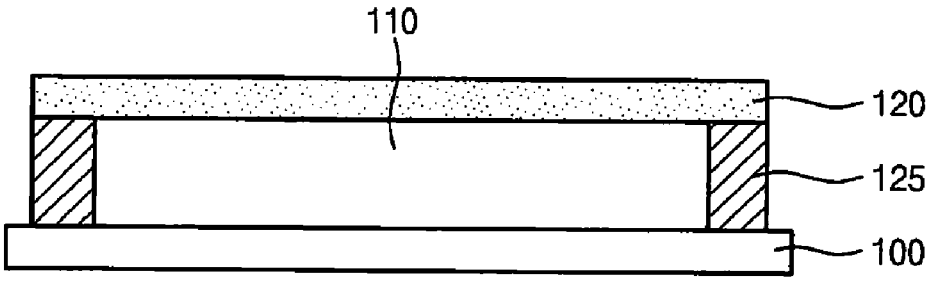

Referring to FIGS. 12A to 12C, a method for fabricating a field emission display device (FED) according to another embodiment of the inventive concept will now be described in detail. Referring to FIG. 12A, an auxiliary electrode layer 123 may be formed on a first substrate 100. The first substrate 100 may be a transparent substrate such as, for example, a glass substrate. The auxiliary electrode layer 123, for example, may include at least one selected from the group consisting of silver (Ag), copper (Cu), nickel (Ni), aluminum (Al), zinc (Zn), titanium (Ti), platinum (Pt), tungsten (W), indium tin oxide, indium zinc oxide, and tin oxide. The auxiliary electrode layer 123 may be formed by conventional thin-film forming methods including a printing method, a metal powder sintering method, a sputtering method, a vacuum evaporation method, a chemical vapor deposition (CVD) method.

Referring to FIG. 12B, an auxiliary electrode frame 125 is formed by patterning the auxiliary electrode layer 123. Alternatively, the auxiliary electrode frame 125 may be formed according to the step of forming the auxiliary electrode layer 123 without performing the patterning.

A phosphor layer 110 is formed on a region defined by the auxiliary electrode frame 125 on the first substrate 100. The phosphor layer 110 may be formed by conventional film forming methods including a printing method, a slurry method, a lithography method, and an electrophoresis method. An intermediate layer 115 may be further formed on the phosphor layer 110. The intermediate layer 115 may be formed by spin-coating a resin emulsion such as, for example, acryl.

Referring to FIG. 12C, an anode electrode 120 is formed on the phosphor layer 110. The anode electrode 120 may be formed by transferring a film coated with a conductive material onto the phosphor layer 110 and baking the transferred film. While the transferred film is baked, the intermediate layer 115 may be removed. Alternatively, the anode electrode 120 may be formed by a conventional conductive thin film forming method including a lacquer method and an emulsion method. As a result, an anode area shown in FIG. 2A may be formed.

Figure 13A:
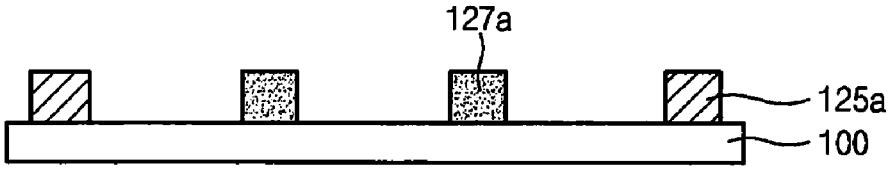
Figure 13B:
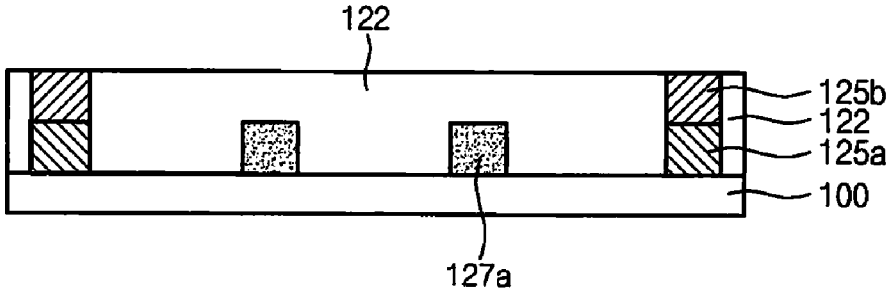
Figure 13C:
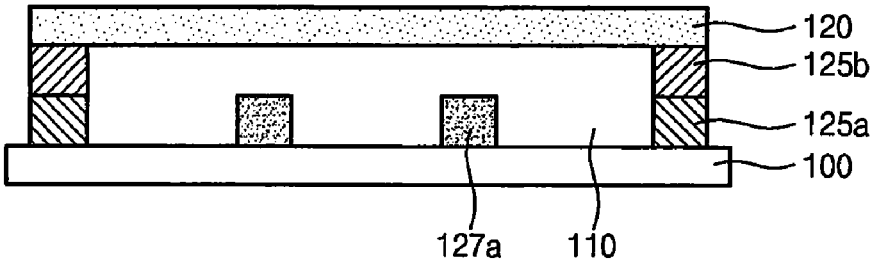

Referring to FIGS. 13A to 13C, a method for fabricating a field emission display device (FED) according to another embodiment of the inventive concept will now be described in detail. Referring to FIG. 13A, a first auxiliary electrode frame 125*a* may be formed on a first substrate 100. First auxiliary electrode patterns 127*a* may be formed on the first substrate 100 within the first auxiliary electrode frame 125*a*. The first auxiliary electrode frame 125*a* and the first auxiliary electrode patterns 127*a* may be formed by forming a first auxiliary electrode layer (not shown) and patterning the same. When the first auxiliary electrode frame 125*a* and the first auxiliary electrode patterns 127*a* are formed, the second auxiliary electrode patterns 127*b* of FIG. 4B may be further formed. The first auxiliary electrode frame 125*a* and the auxiliary electrode patterns 127*a* and 127*b* may be formed by the same patterning process.

Referring to FIG. 13B, a second auxiliary electrode frame 125*b* may be formed on the first substrate 100. The second auxiliary electrode frame 125*b* may be formed by, for example, forming printing masks 122 on the substrate 100 to expose the first auxiliary electrode frame 125*a*, coating a second auxiliary electrode layer (not shown) on the exposed first auxiliary electrode frame 125*a* and then baking the second auxiliary electrode layer. The printing masks 122 may be removed before and/or after baking the second auxiliary electrode layer. Alternatively, unlike illustrated, the second auxiliary electrode frame 125*b* may be formed by conventional thin-film forming methods including a sputtering method, a vacuum evaporation method, and a chemical vapor deposition (CVD) method Referring to FIG. 13C, a phosphor layer 110 may be formed in a region defined by the first auxiliary electrode frame 125*a* and the second auxiliary electrode frame 125*b* on the first substrate 100. The phosphor layer 110 may be formed by conventional film forming methods including a printing method, a slurry method, a lithography method, and an electrophoresis method.

An anode electrode 120 may be formed on the phosphor layer 110. The anode electrode 120 may be formed such that its edge is in contact with the second auxiliary electrode frame 125*b*. The anode electrode 120 may be formed by a conventional conductive thin film forming method including a lacquer method and an emulsion method. As a result, an anode area shown in FIGS. 3A and 4A may be formed.

Figure 14A:
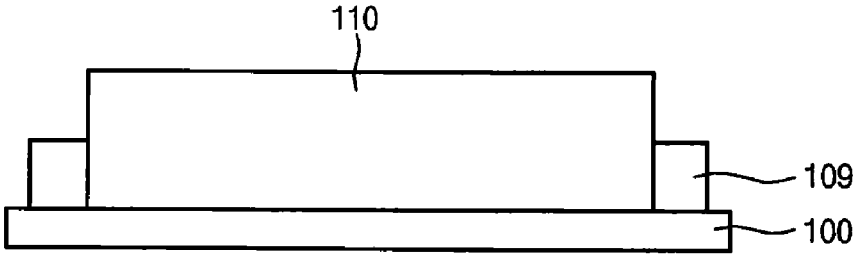
Figure 14B:
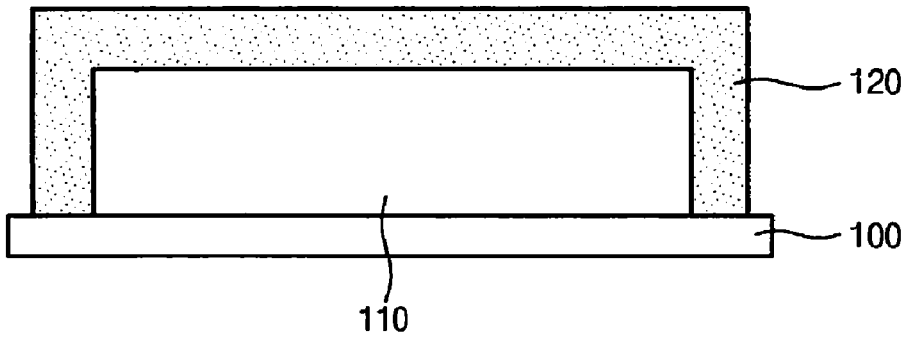

Referring to FIGS. 14A and 14B, a method for fabricating a field emission display device (FED) according to another embodiment of the inventive concept will now be described in detail. Referring to FIG. 14A, a phosphor layer 110 is formed on a first substrate 100. The phosphor layer 110 may be formed by forming phosphor printing masks 109 on the first substrate 100 to expose a portion of the first substrate 100, coating phosphor on the exposed portion of the substrate 100, and drying the coated phosphor. The phosphor printing mask 109 may be removed before and/or after drying the coated phosphor. Prior to formation of the anode electrode 120, an intermediate layer (not shown) may be further formed to cover the phosphor layer 110.

Referring to FIG. 14B, an anode electrode 120 may be formed on the first substrate 100 to cover the phosphor layer 110. For example, the anode electrode 120 may be formed by transferring a film coated with a conductive material onto the phosphor layer 110 and baking the transferred film. While the transferred film is baked, the intermediate layer (not shown) may be removed. Alternatively, the anode electrode 120 may be formed by a conventional conductive thin film forming method including a lacquer method and an emulsion method. As a result, an anode area shown in FIG. 5A may be formed.

Figure 15A:
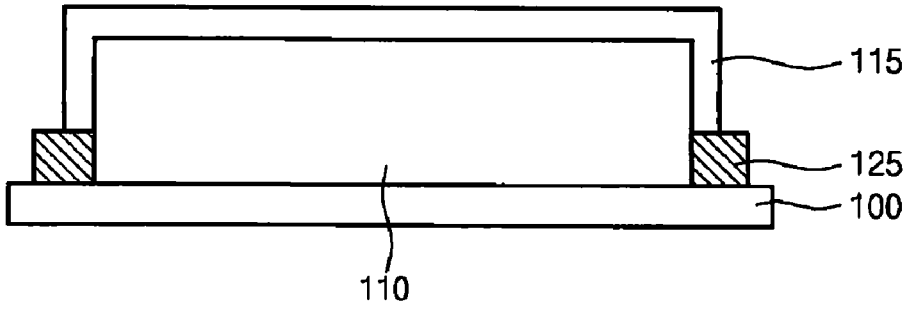
Figure 15B:
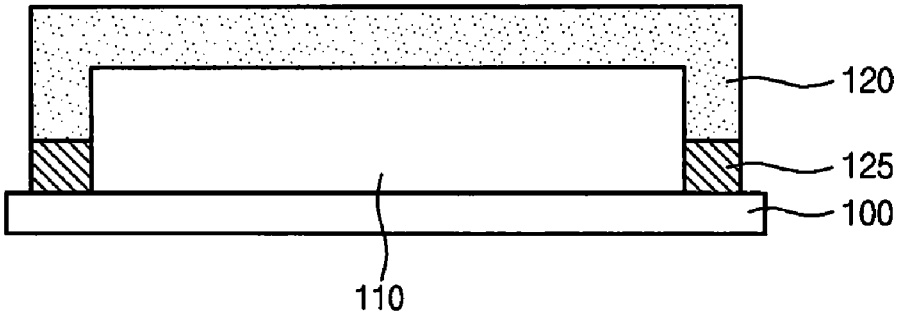

Referring to FIGS. 15A and 15B, a method for fabricating a field emission display device (FED) according to another embodiment of the inventive concept will now be described in detail. Referring to FIG. 15A, an auxiliary electrode frame 125 may be prepared on a first substrate 100. A phosphor layer 110 is formed on the first substrate 100. The phosphor layer 110 may fill a region defined by the auxiliary electrode frame 125 on the first substrate 100. The phosphor layer 110 may be formed to expose its top surface and a portion of its side surface. An intermediate layer 115 may be formed on the exposed top surface of the phosphor layer 110 and on the exposed the portion of the side surface of the phosphor layer 110.

Referring to FIG. 15B, an anode electrode 120 is formed to cover the phosphor layer 110. The anode electrode 120 may be formed to include a projection that is in contact with the auxiliary electrode frame 125. For example, the anode electrode 120 may be formed by transferring a film coated with a conductive material onto the phosphor layer 110 and baking the transferred film. The intermediate layer 115 may be removed while baking the transferred film. Alternatively, the anode electrode 120 may be formed by a conventional conductive thin film forming method including a lacquer method and an emulsion method. As a result, an anode area shown in FIG. 6A may be formed.

Figure 16A:
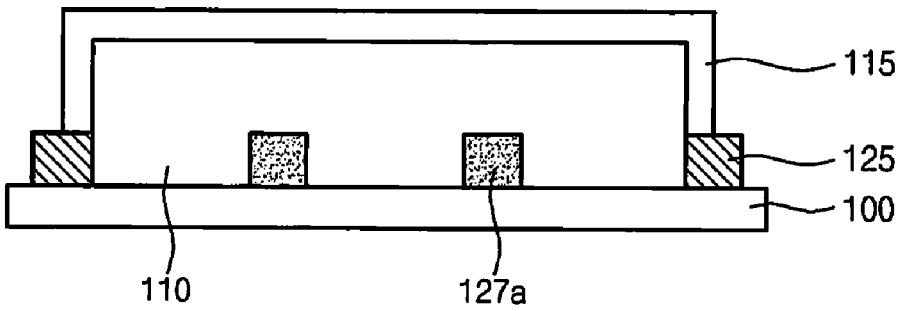
Figure 16B:
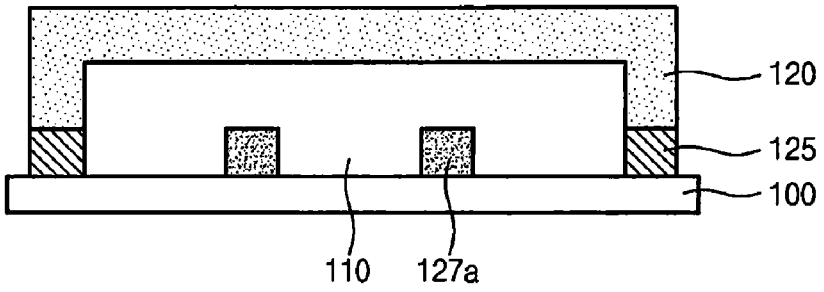

Referring to FIGS. 16A and 16B, a method for fabricating a field emission display device (FED) according to another embodiment of the inventive concept will now be described in detail. Referring to FIG. 16A, an auxiliary electrode frame 125 and first auxiliary electrode patterns 127*a* may be formed on a first substrate 100. The Second auxiliary electrode patterns 127*b* of FIG. 8B may be further formed during formation of the auxiliary electrode frame 125 and the first auxiliary electrode patterns 127*a*. A phosphor layer 110 may be formed on the first substrate 100. The phosphor layer 110 may fill a region defined by the auxiliary electrode frame 125 and the first auxiliary electrode patterns 127*a*. The phosphor layer 110 may be formed to expose its top surface and a portion of its side surface that is not contact with the auxiliary electrode frame 125.

Referring to FIG. 16B, an anode electrode 120 may be formed on the auxiliary electrode frame 125 to cover the phosphor layer 110. The anode electrode 120 may be formed to cover the exposed portion of the phosphor layer 110. As a result, an anode area shown in FIGS. 7A and 8A may be formed.

Figure 17A:
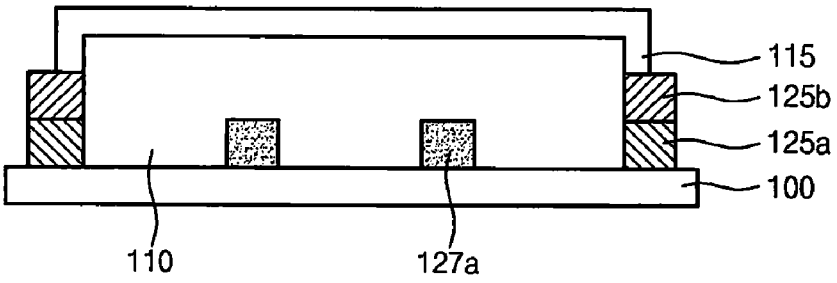
Figure 17B:
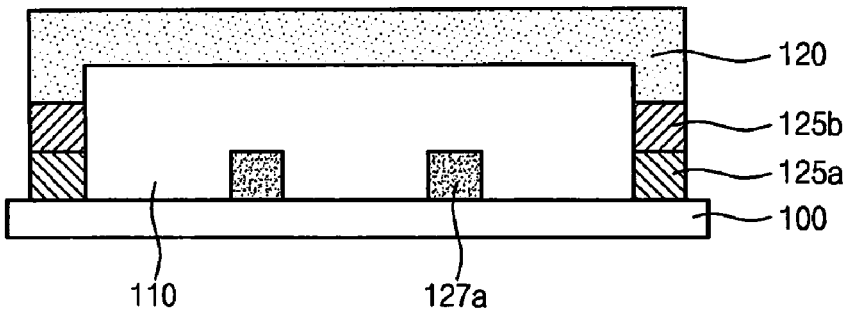

Referring to FIGS. 17A and 17B, a method for fabricating a field emission display device (FED) according to another embodiment of the inventive concept will now be described in detail. Referring to FIG. 17A, a first auxiliary electrode 125*a* and first auxiliary electrode patterns 127*a* may be formed on a first substrate 100. Second auxiliary electrode patterns 127*b* of FIG. 10B may be further formed on the first substrate 100 to cross the first auxiliary electrode patterns 127*a*. A second auxiliary electrode frame 125*b* may be formed on the first auxiliary electrode frame 125*a*. For example, the second auxiliary electrode frame 125*b* may be formed by forming mask patterns (not shown) on the first substrate 100 to expose the first auxiliary electrode frame 125*a*, coating a conductive material on the exposed first auxiliary electrode frame 125*a*, and baking the coated conductive material. The mask patterns may be removed before and/or after baking the coated conductive material. Alternatively, the second auxiliary electrode frame 125*b* may be formed by forming a conductive thin film on the phosphor layer 110 and the first auxiliary electrode frame 125*a* and patterning the conductive thin film. A phosphor layer 110 is formed on the first substrate 100.

Referring to FIG. 17B, An anode electrode 120 is formed on the first substrate 100. The anode electrode 120 may be formed to include a projection that is in contact with the second auxiliary electrode frame 125*b*. As a result, an anode area shown in FIGS. 9A and 10A may be formed.

Referring to tables in FIGS. 18 and 19 and the following tables, effects of a field emission display device (FED) according to embodiments of the inventive concept will now be described in detail below. Values given in the tables are luminance measuring values which are obtained by applying a voltage of 10 kilovolts to an anode electrode of an FED according to each of embodiments and comparative embodiments and applying a pulse voltage of 200 volts to a gate electrode of the FED.

| | COM_1 | COM_2 | EMB_1 | EMB_2 | EMB_3 |
|---|---|---|---|---|---|
| Luminance ($cd/m^2$) | 5000 | — | 5650 | 5500 | 5650 |
| Luminance Improving Rate compared to COM_1 | — | — | 13 | 10 | 13 |
| Sheet Resistance of Anode Electrode (Ω/sq) | 5 | 1000 | 5 | 5 | 5 |

(COM = Comparative Embodiment, EMB = Embodiment)

Figure 18:
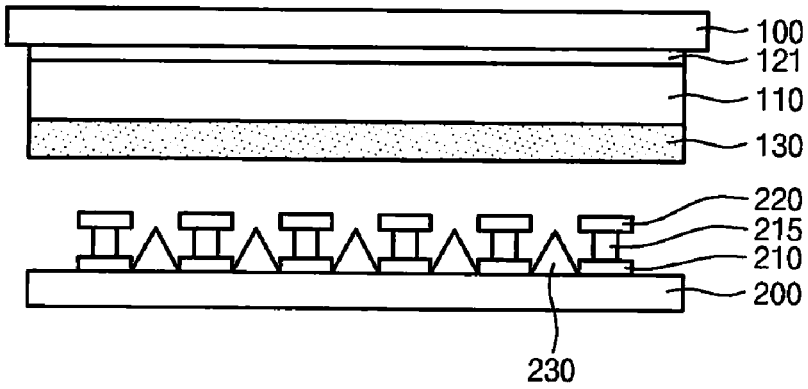
FIGS. 18 and 19 are views illustrating effects of field emission display devices according to embodiments of the inventive concept.

Referring to FIG. 18, a first comparative embodiment includes a first substrate 100, an anode electrode 121 on the first substrate 100, and a phosphor layer 110 and an anti-reflective layer 130 on the anode electrode 121. The anode electrode 121 is a transparent electrode including indium tin oxide (ITO), and the anti-reflective layer 130 includes aluminum (Al). A second substrate 200 facing the first substrate 100 and a cathode electrode 210, a gate electrode 220, an insulating layer 215, and an emitter 230 on the second substrate 200 are provided. According to the first comparative embodiment, electrons collide with phosphor of the phosphor layer 110 to emit light and the emitted light is implemented as an image by passing the anode electrode 121 and the first substrate 100. Thus, a field emission display device (FED) according to the first comparative embodiment has lower luminance than that according to other embodiments.

Figure 19:
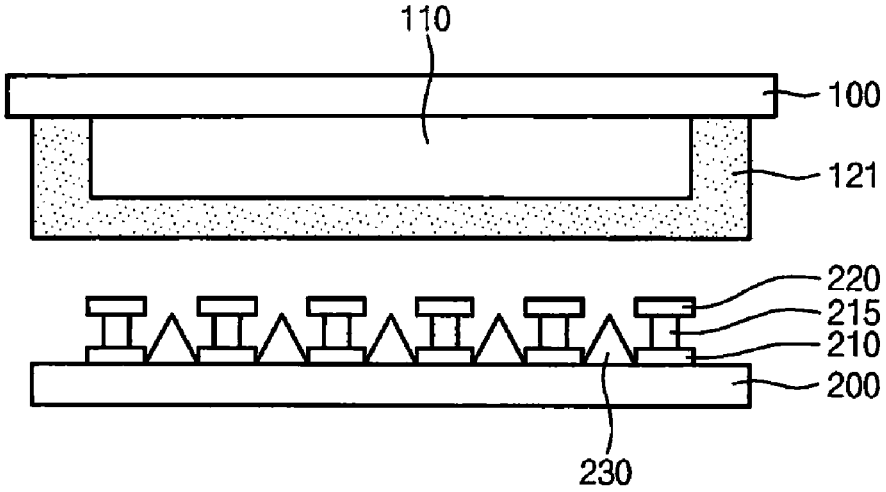

Referring to FIG. 19, the second comparative embodiment includes a first substrate 100, a phosphor layer 110 on the first substrate 100, and an anode electrode 121 disposed on the phosphor layer 110 and including a projection protruded to the first substrate 100. A second substrate 200 facing the first substrate 100 and a cathode electrode 210, a gate electrode 220, an insulating layer 215, and an emitter 230 on the second substrate are provided. The anode electrode 121 is a metal having sheet resistance of 1000 ohms/square. According to the second comparative embodiment, arcing arises from charging because the conductivity of the anode electrode 121 is poor due to its high sheet resistance. Therefore, it was impossible to measure luminance of the second comparative embodiment.

The first embodiment is the luminance of a field emission display device (FED), which is measured according to the embodiments described with reference FIGS. 3A to 4B. A first auxiliary electrode frame 125*a* and first and second electrode patterns 127*a* and 127*b* are indium tin oxide (ITO), and a second auxiliary electrode frame 125*b* is a metal containing silver (Ag) and copper (Cu) and a combination thereof. A field emission display device (FED) according to the first embodiment had improved luminance of 13 percent as compared to the first comparative embodiment and exhibited superior driving stability.

The second embodiment is the luminance of a field emission display device (FED), which is measured according to the embodiments described with reference to FIGS. 6A to 8B. An auxiliary electrode frame 125 and first and second auxiliary electrode patterns 127*a* and 127*b* are a metal containing silver (Ag) and copper (Cu) and a combination thereof, and an anode electrode 120 is a metal having sheet resistance of 5 ohms/square. A field emission display device (FED) according to the second embodiment had improved luminance of 10 percent as compared to the first comparative embodiment and exhibited superior driving stability.

The third embodiment is the luminance of a field emission display device (FED), which is measured according to the embodiments described with reference to FIGS. 6A to 8B. An auxiliary electrode frame 125 and first and second auxiliary electrode patterns 127*a* and 127*b* are indium tin oxide (ITO), and an anode electrode 120 is a metal having sheet resistance of 5 ohms/square. A field emission display device (FED) according to the third embodiment had improved luminance of 13 percent as compared to the first comparative embodiment and exhibited superior driving stability.

As explained so far, in a field emission display device (FED) according to embodiments of the inventive concept, emitted light is implemented as an image without passing an anode electrode. Thus, luminance of the FED is improved. In addition, a field emission display device (FED) according to embodiments of the inventive concept has improved adherence between an anode electrode and a phosphor layer. Thus, luminance of the FED is improved.

While the inventive concept has been described with reference to exemplary embodiments, it will be apparent to those skilled in the art that various changes and modifications may be made without departing from the spirit and scope of the inventive concept. Therefore, it should be understood that the above embodiments are not limiting, but illustrative.

What is claimed is:

1. A field emission display device comprising:

a first substrate;

a phosphor layer on the first substrate, the phosphor layer being in contact with the first substrate;

an anode electrode on the phosphor layer;

a second substrate facing the first substrate and including a cathode electrode and an emitter extended toward the anode electrode; and an auxiliary electrode frame disposed on the edge of the anode electrode, extending toward the first substrate, and being in contact with the first substrate.

2. The field emission display device of claim 1, wherein the auxiliary electrode frame comprises:

a first auxiliary electrode frame adjacent to the first substrate; and a second auxiliary electrode frame adjacent to the anode electrode, wherein the first auxiliary electrode frame includes at least one selected from the transparent conductive material group consisting of indium tin oxide, indium zinc oxide, and tin oxide.

3. The field emission display device of claim 2, further comprising:

a first auxiliary electrode pattern extending between the first substrate and the phosphor layer in a first direction, the first auxiliary electrode pattern being electrically connected to the auxiliary electrode frame.

4. The field emission display device of claim 3, further comprising:

a second auxiliary electrode pattern extending between the first substrate and the phosphor layer in a second direction crossing the first direction, the second auxiliary electrode pattern being electrically connected to the auxiliary electrode frame and the first auxiliary electrode pattern.

5. The field emission display device of claim 1, wherein the auxiliary electrode frame comprises the same material as the anode electrode.

6. The field emission display device of claim 1, wherein the anode electrode include a metal having sheet resistance of 100 ohms/square.

7. The field emission display device of claim 1, wherein the anode electrode includes a projection disposed on the edge of the anode electrode and protruded toward the first substrate.

* * * * *